United States Patent [19]

Muscatell

[11] 4,393,838

[45] Jul. 19, 1983

[54] THERMAL AND VACUUM TRACKING CARBURETOR JET WITH ELECTRONIC CONTROL

[76] Inventor: Ralph P. Muscatell, Ft. Lauderdale, Fla.

[21] Appl. No.: 314,247

[22] Filed: Oct. 23, 1981

[51] Int. Cl.[3] ..... F02M 7/00; F02M 1/04

[52] U.S. Cl. ..... 123/435; 123/440; 261/39 B; 261/50 A; 261/69 R; 261/39 D

[58] Field of Search ..... 123/435, 440; 261/39 B, 261/39 D, 69 R, 50 A; 60/285, 277

[56] References Cited

U.S. PATENT DOCUMENTS

| | | | |
|---|---|---|---|
| 2,969,965 | 1/1961 | Braun | 261/39 B |
| 3,228,171 | 10/1966 | Carlson | 261/39 D |
| 3,263,974 | 8/1966 | Braun | 261/39 |
| 4,192,140 | 3/1980 | Yamashita et al. | 60/277 |
| 4,192,140 | 3/1980 | Yamashita et al. | 60/285 |
| 4,295,450 | 10/1981 | Muscatell | 123/435 |
| 4,347,571 | 8/1982 | Leung et al. | 123/435 |

*Primary Examiner*—Raymond A. Nelli
*Attorney, Agent, or Firm*—Oltman and Flynn

[57] ABSTRACT

A Thermal and Vacuum Tracking Carburetor With Jet Electronic Control System which allows the continuous monitoring of the temperature of the exhaust gas and the manifold vacuum of an internal combustion engine.

5 Claims, 7 Drawing Figures

FIG. 6
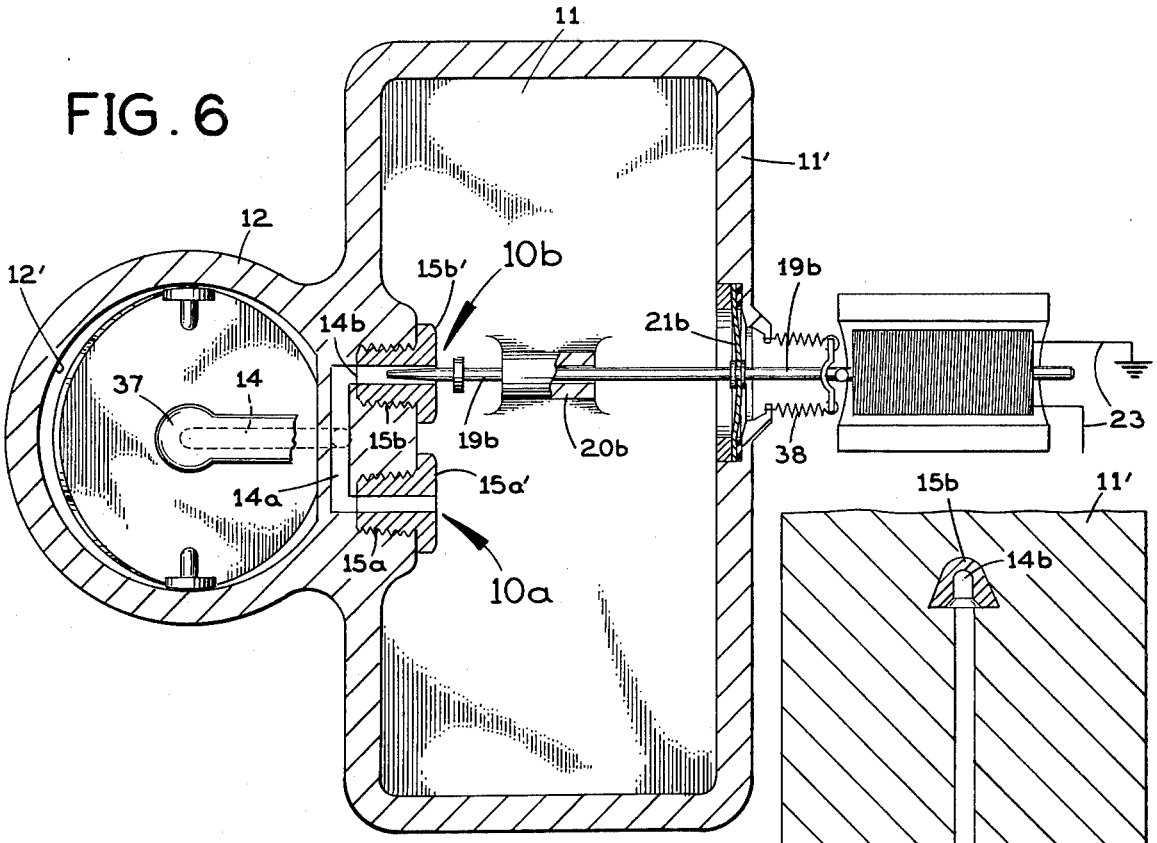
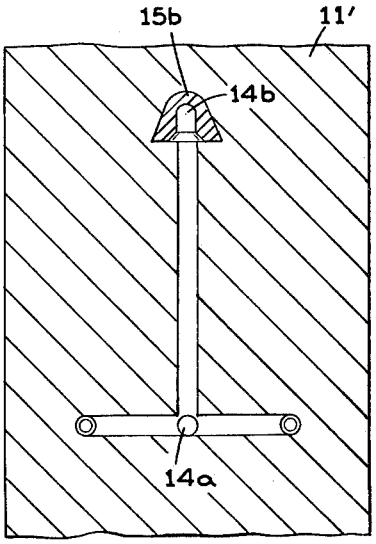
FIG. 5
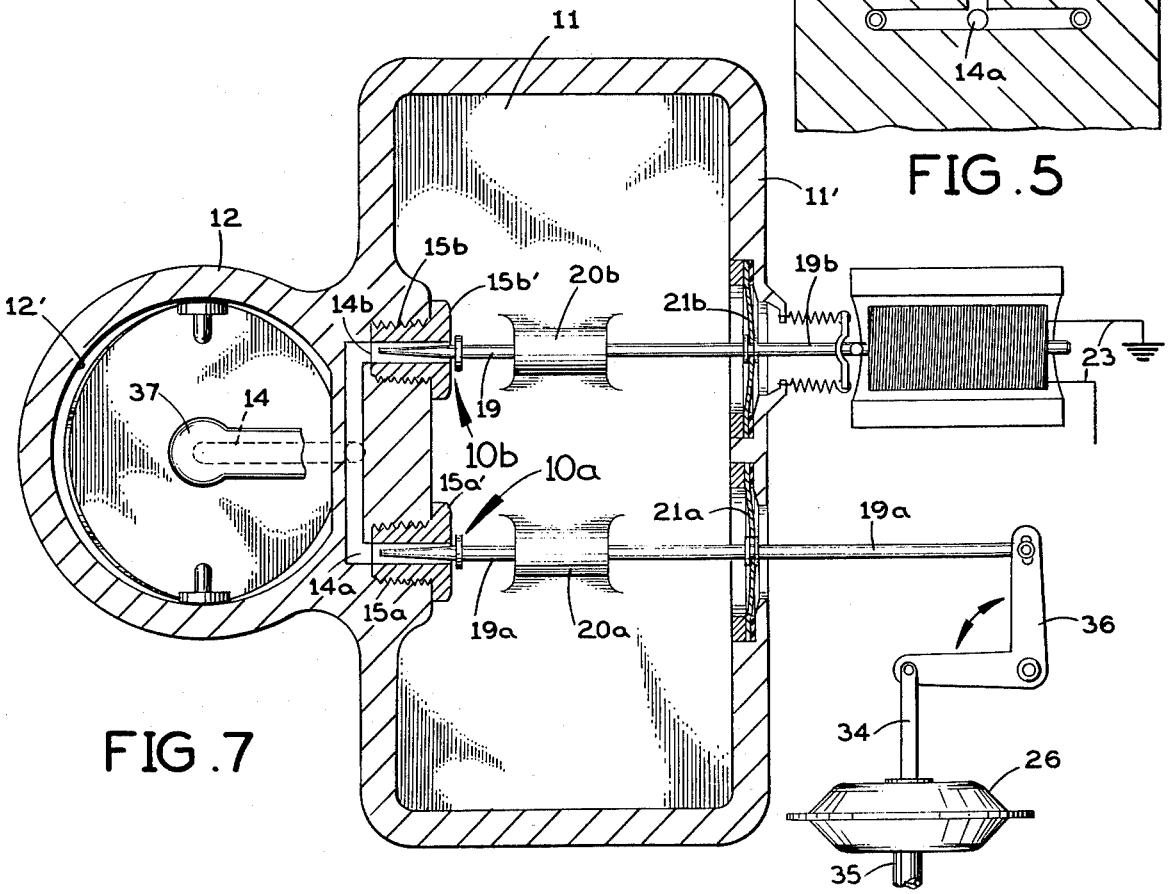
FIG. 7

THERMAL AND VACUUM TRACKING CARBURETOR JET WITH ELECTRONIC CONTROL

RELATED APPLICATION

This application is an improvement over my U.S. patent application Ser. No. 970,994, filed Dec. 19, 1978.

BACKGROUND OF THE INVENTION

The present invention is directed to a novel and improved exhaust gas and vacuum tracking carburetor jet for installation in an internal combustion engine. The invention tracks both the exhaust gas emission temperature and intake manifold vacuum. The object of the invention is to achieve the optimum fuel-air combination for the conditions tracked. In response to temperature variations in the exhaust gas and vacuum differences in the manifold fuel is metered between the fuel chamber and fuel/air mixing chamber. The metering occurs in direct proportion to the changes sensed. As the temperature of the exhaust gas rises and/or the intake minifold vacuum decreases the system detects these changes and causes a metering orifice between the two chambers to expand allowing additional fuel to traverse. When the temperature decreases or vacuum increases the metering orifice shrinks cutting down on the supply of fuel. High exhaust gas temperatures indicate too lean a fuel/air mixture or increasing power consumption. While a decrease in the manifold vacuum is indicative of an engine under an increasing load. The invention compensates for these conditions by adjusting the fuel/air mixture. Through the years several mechanical devices have been presented.

For example, U.S. patent application Ser. No. 970,994 to Muscatell describes the simultaneous monitoring of an internal combustion engine's exhaust gas and intake maifold vacuum to mechanically meter fuel to the carburetor in order to enrich or lean the fuel/air mixture to the optimum ratio.

U.S. Pat. No. 3,263,974 to Braun shows a carburetor system in which the fuel/air mixture is enriched when the engine temperature is low, referring to this as "cold weather enrichment". In addition, the system of this patent enriches the fuel/air mixture when the intake manifold vacuum drops during high power demand or the engine, such as when the vehicle is being accelerated.

U.S. Pat. No. 4,192,140 to Yamashita illustrates a two-stage response when the engine vacuum at the intake increases in response to closing of the throttle valve when the vehicle decelerates. In the first step the fuel/air mixture is made leaner by adding more air and in the second step after a time delay of 1 or 2 seconds additional fuel is introduced into the fuel/air mixture. In the Yamashita invention when the engine intake vacuum increases the fuel/air mixture is leaned and after a brief delay is enriched.

SUMMARY OF THE INVENTION

The present invention provides continuous monitoring of both the exhaust gas temperature and manifold vacuum of an internal combustion engine and electrically transmit changes to a metering orifice in order to control the fuel supply by varying of the fuel/air mixture. A thermistor is placed in the exhaust gas conduit and a transducer is placed in the vacuum intake manifold to detect temperature and pressure variations, respectively. As the exhaust gas temperature rises the resistance of the thermistor decreases and the thermistor passes an increased electrical current proportional to the increase in temperature sensed. The increased temperature of the exhaust gas indicates that the fuel/air mixture at the carburetor is too lean and/or the engine is under a heavy load. The electrical current increases and is amplified and directed to a linear drive electric motor which controls the positioning of a rod and stem located in a metering orifice of a valve between the storage and fuel/air mixing chambers. The motor draws the rod and stem away from the metering orifice allowing an increased amount of fuel to pass from the storage to the fuel/air mixing chamber. When the temperature of the exhaust gas decreases a corresponding increase in the thermistor resistance and decreases in electrical current occurs which causes the linear drive electric motor and a spring to insert the rod and stem into the metering orifice and decreases the amount of fuel being supplied by varying the fuel/air mixture.

A vacuum transducer connected to the intake manifold is mechanically connected to a plunger acting on a resistor in a fashion to increase the electrical current in the circuit for a reduction in vacuum and decrease the electric current at a higher vacuum. The increased electrical current is amplified and acts on the electric linear drive motor in the same manner as the current from the exhaust gas circuit to withdraw the rod and stem from the metering orifice and cause increased fuel to flow between the storage and mixing chambers. Decreasing the electrical current reduces the electric linear drive motor's pull allowing the spring to draw on the rod and stem. This process results in less fuel passing between the chambers. An alternate embodiment of this invention allocates an electric linear drive motor, a rod and stem and valve with a metering orifice to both the exhaust gas and vacuum pressure systems with the metering orifices combining into one emission. Another embodiment is identical with the previous embodiment with the electric linear drive motor in the vacuum system replaced by mechanical linkage and a fourth embodiment has a valve with an orifice fixed in the open position united with a regulated valve in the exhaust gas system.

A principal object of this invention is to furnish a novel and improved means for instantaneously and continuously adjusting the emission of fuel between the fuel storage and mixing chambers by varying the fuel/air ratio.

Another object of this invention is to utilize the resistance qualities of a thermistor to vary an electric current in proportion and direction to the change in temperature of the exhaust gas from an internal combustion engine.

Another object of this invention is to utilize a transducer in combination with a resistor to vary an electric current in proportion to the change in the manifold vacuum of an internal combustion engine.

Another object of this invention is to provide an electric linear drive motor to position a rod and stem in a metering orifice in order to regulate the amount of fuel passing between the fuel storage and mixing chambers.

Another object of this invention is to provide an electric linear drive motor having an armature with twin windings, one winding responsive to the amplified electric current in the exhaust gas system and the other winding responsive to the electrical current in the manifold pressure vacuum system.

Another object of this invention is to provide electric linear drive motors with one motor responsive to the amplified current in the exhaust gas system and regulating a metered orifice and another motor responsive to the current in the manifold vacuum sensing system and regulating an alternate metered orifice.

Further objects and advantages of the present invention will be apparent from a detailed description of certain presently-preferred embodiments thereof shown in the accompanying drawings in which:

FIG. 5 is a latitudinal cross-sectional fragmentary view along 5—5 in FIG. 4;

Figure 4:
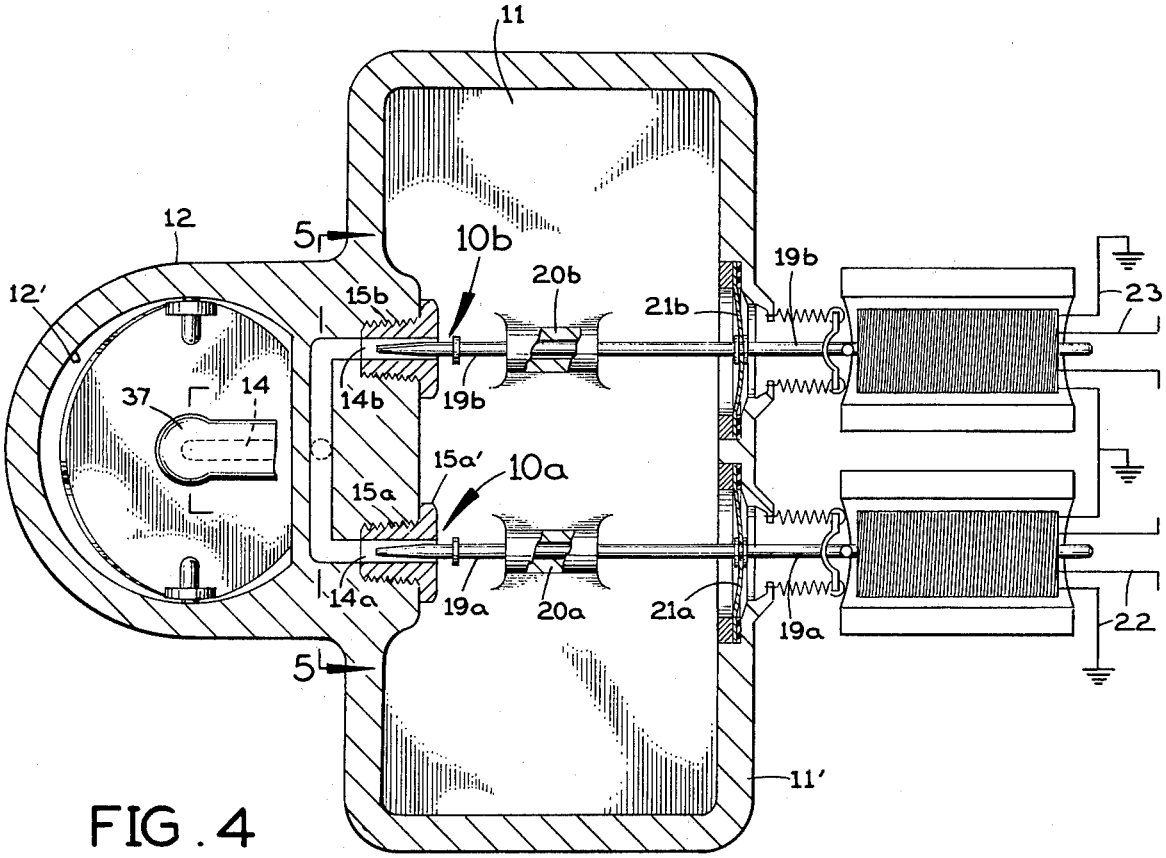
FIG. 4 is a view similar to FIG. 1, but illustrating interconnected fuel meter valves regulated by individual electric linear drive motors included in the exhaust gas and manifold vacuum pressure systems.

FIG. 6 is a view similar to FIG. 4, but illustrating interconnected fuel metering valves, one valve being fixed in an unobstructed position insuring 50% of the fuel is to be passed, the alternate valve regulated by an electrical linear drive motor in response to the exhaust gas system and the manifold vacuum regulating a bypass route (not shown) around the interconnected valves to insure the fuel/air mixture is responsive to the manifold vacuum variations; and FIG. 7 is a view similar to FIG. 4, but illustrating interconnected fuel metering valves with one valve regulated by a mechanical vacuum transducer and the alternate valve regulated by the exhaust gas system by means of thermistor, amplifier and electric linear drive motor.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

Figure 2:
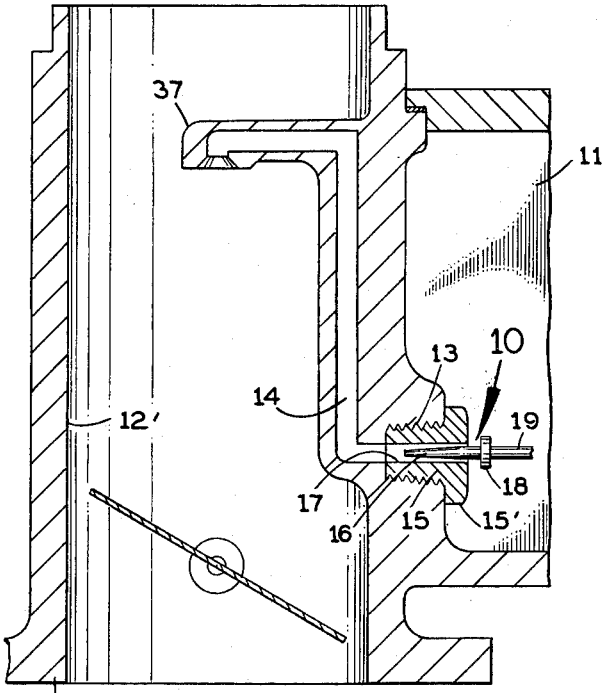
FIG. 2 is a longitudinal cross-section view along 2—2 in FIG. 1 detailing a fuel mixing conduit having an air inlet at one end and a fuel/air outlet at an opposite end and a venturi throat between the inlet and outlet.

The first embodiment of the present invention (FIGS. 1–3) has a single variable jet comprising a jet with a metered hole 10 (FIG. 2) fitted with valve stem 16 for metering the flow of gasoline or other fuel from a fuel chamber 11 into a fuel/air mixing conduit 12 leading to the cylinders of an internal combustion engine (not shown). The fuel/air mixing conduit is formed with the jet 10, a screw-threaded opening 13 leading into a passageway 14 for passing fuel from the fuel chamber 11 into the fuel/air passageway 12' via conduit 14 and spray head 37.

Figure 3:
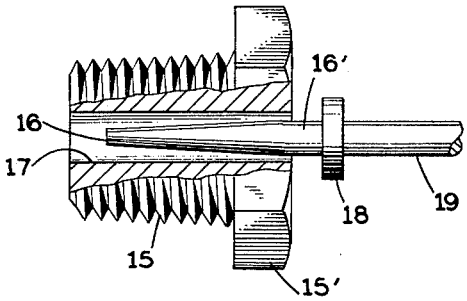
FIG. 3 is a cut-away of the valve in FIGS. 1 and 2 detailing the stem which centrally traverses the metering valve.

The valve comprises an externally screw-threaded nipple 15 and a tapered stem 16, shown in enlarged detail in FIG. 3. The nipple 15 is threadedly received in the opening 13 in conduit 12 and it presents a transversely enlarged hexagonal head 15' on its outer end which abuts against the outside of conduit 12 when the nipple is in place. The nipple is formed with a central cylindrical passageway 17 whose inner end opens into the fuel passageway 14. The outer end of the nipple passageway 17 communicates with the fuel chamber 11 to receive fuel therefrom under the control of the valve stem 16. The valve stem 16 for most of its length has a tapered, frusto-conical periphery where it extends into the nipple passageway 17 and partially restricts the flow of fuel through it in accordance with the position of the tapered valve stem longitudinally of this passageway. Toward its outer end (the right end in FIGS. 2 and 3) the valve stem 16 presents a short cylindrical segment 16' of slightly smaller diameter than the nipple passageway 17 and a transverse cylindrical head 18 for engagement with the nipple head 15' to close the inlet end of the nipple passageway 17 in one extreme position of the valve stem 16.

Figure 1:
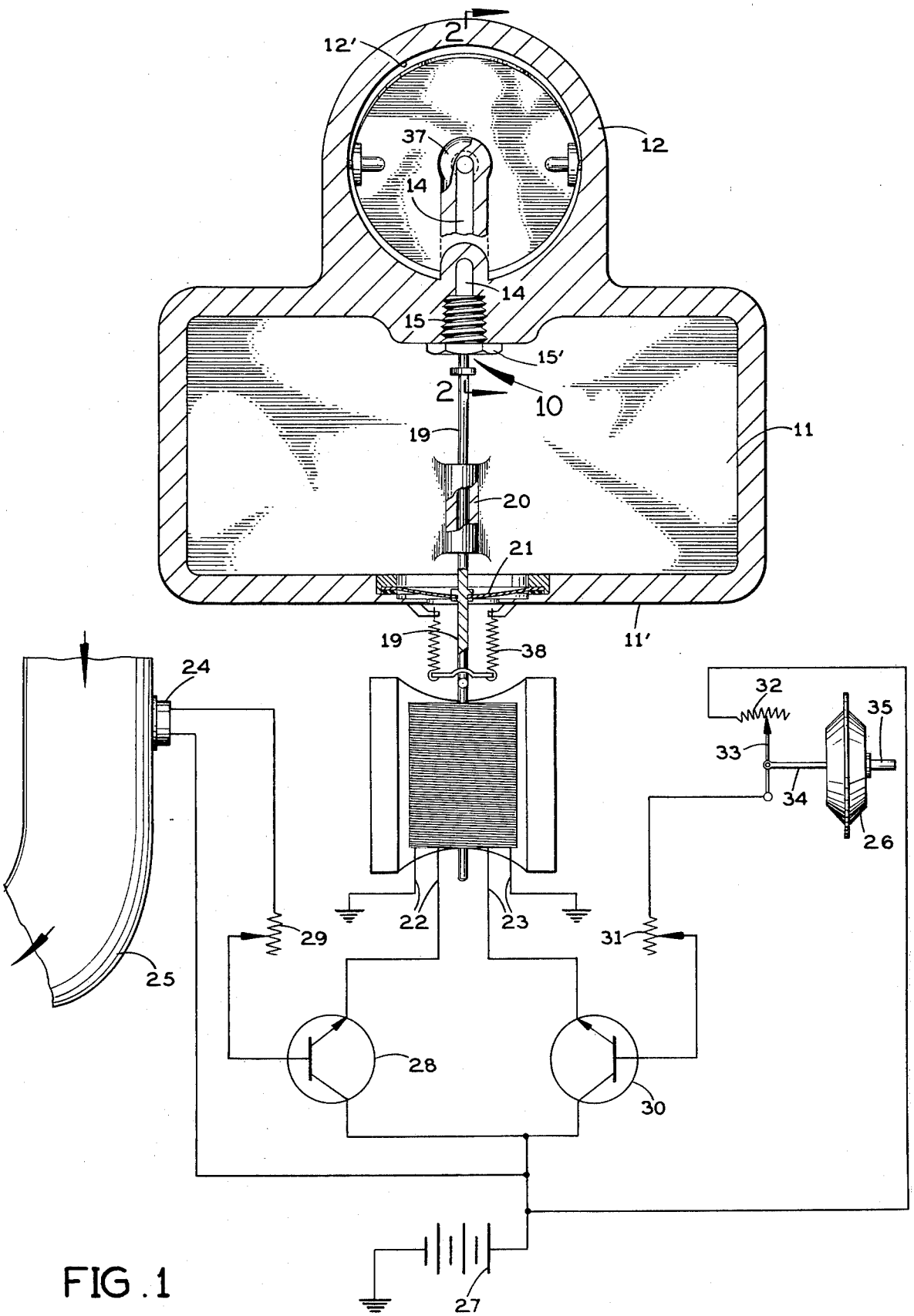
FIG. 1 is a schematic view illustrating electronically responsive exhaust gas and manifold vacuum systems which amplify electric currents in order to direct an electric linear drive motor controlling a rod and stem which penetrates and meters an orifice to control the emission of fuel in a nozzle between the storage and mixing chambers.

The valve stem 16 and head 18 are on the end of a rigid rod 19 which, as shown in FIG. 1, is slidably mounted reciprocably in a guide sleeve 20 located inside the fuel chamber 11. The longitudinal position of rod 19, and thus the longitudinal position of the valve stem 16 along the fuel passageway 17 in the valve nipple 15, is controlled jointly by the engine vacuum pressure and by the engine exhaust temperature in a manner now to be explained.

As shown in FIG. 1, the rod 19 extends through a flexible, resilient diaphragm 21 mounted in a wall 11' of the housing which defines the fuel chamber 11. The outer end of the rod 19 is attached to the longitudinally armature of a linear electric motor of known design having two field windings 22 and 23 which jointly control the longitudinal position of the armature. The first winding 22 has its energization under the control of a thermistor 24 of known design mounted in the engine exhaust gas conduit 25 to sense the temperature of the exhaust gases from the engine. Winding 23 has its energization under the control of a pressure-responsive transducer 26 of known design which senses the vacuum of the vacuum intake manifold of the engine.

The control circuit for motor winding includes the vehicle battery 27, an amplifier 28 and a manually adjustable potentiometer 29. The positive terminal of battery 27 is connected directly to the collector of amplifier 28 and to one terminal of thermistor 24. The opposite terminal of the thermistor is connected through potentiometer 29 to the base of amplifier 28. The emitter of the amplifier is connected directly to one terminal of the motor winding 22, and the opposite end of this winding is grounded. The thermistor 24 constitutes a variable resistance which controls the current through the collector-emitter path of amplifier 28 to the motor winding 22 in accordance with the engine exhaust temperature.

As the engine exhaust temperature increases, the thermistor 24 presents a correspondingly reduced resistance so that the amplified current to the motor winding 22 will increase and cause the motor armature to move down in FIG. 3 and pull the tapered valve stem 16 farther out of the valve nipple passageway 17 to increase the flow of fuel into the fuel/air mixing conduit 12'. Conversely, a reduction of the engine exhaust temperature will decrease the amplified current in the motor winding 22 and allow the tapered valve stem 16 to react to spring tension 38 and move farther into the valve nipple passageway 17 to increase the flow restriction between the fuel chamber 11 and the fuel/air mixing conduit 12.

The control circuit for the other motor winding 23 includes the vehicle battery 27, an amplifier 30, a manually adjustable potentiometer 31, and a potentiometer 32 which is operated by the transducer 26. The positive battery terminal is connected directly to the collector of transistor 30 and to one end of the resistance winding of potentiometer 32. The base of amplifier 30 is connected through potentiometer 31 to the adjustable contact 33 of potentiometer 32. The emitter of amplifier 30 is connected to one end of the motor winding 23, the opposite end of which is grounded. Potentiometer contact 33 is pivotally coupled to a reciprocable stem 34 operated by the pressure-sensing transducer 26 so that the effective resistance provided by potentiometer 33 will vary with the vacuum in the engine intake manifold. Transducer 26 has a flexible and resilient diaphragm (not shown) which is connected to stem 34 and is exposed on one side (the right side in FIG. 1) to the vacuum in the engine intake manifold through a conduit 35. The diaphragm will move to the left or right in FIG. 1 in response to vacuum changes in the engine intake manifold.

A reduction in the engine intake vacuum manifold will operate transducer 26 to move stem 34 to the left in FIG. 1, causing a reduction in the effective resistance of potentiometer 32, which increases the amplified current in the motor winding 23. This causes the motor armature to pull the tapered valve stem 16 farther out of the valve nipple passageway 17, thereby increasing the flow of fuel through valve 10 from the fuel chamber 11 into the fuel/air mixing conduit 12. Conversely, a higher vacuum in the engine vacuum intake manifold will decrease the amplified current in the motor winding 23 and allow the tapered valve stem 16 to insert farther into the valve nipple passageway 17 reacting to spring 38 in order to increase the flow restriction provided by valve 10 between the fuel chamber 11 and the fuel/air mixing conduit 12.

The second embodiment of the invention (FIG. 4) has two fuel metering valves **10*a* and 10*b* which are controlled individually by the engine exhaust temperature and the engine intake manifold vacuum, respectively. The valves are constructed and function identically to valve 10 in the embodiment illustrated in FIG. 1, and the same control circuits are connected to windings 22 and 23**.

As shown in FIG. 1, the rods **19*a* and 19*b* extend through flexible, resilient diaphragms 21*a* and 21*b*, respectively. The outer end of the rod 19*a* is attached to the longitudinal armature of a first linear electric motor of known design having a field winding 22 which controls the longitudinal position of the armature. Rod 19*a* functions in a like manner in cooperation with the second linear electric motor having a field winding 23**.

Temperature increases and decreases in the engine exhaust temperature act on winding 22 and vacuum increases and decreases of the intake manifold vacuum act on winding 23 causing fuel metering valves **14*a* and 14*b*, respectively, to adjust the fuel flow in accordance with amplified currents applied to the windings. The joint fuel flow being combined into one emission as shown in FIG. 5, through fuel passageway 14 previously to entering into the fuel/air passageway 12'**.

The third embodiment of the invention (FIG. 6) features the two fuel valves **10*a* and 10*b* arrangement of the second embodiment (FIG. 4) and allocates the metering of valve 10*b* to responses from the temperature changes in the exhaust gas. Valve 10*a* is unobstructed and insures 50% of the fuel supply under the control of the exhaust gas system passing into the fuel/air mixing chamber 12'**. In addition the invention accommodates a by-pass valve (not shown) responsive to changes in the intake manifold vacuum to allow the fuel/air mixture to account for these changes. It is accepted prior art in which the by-pass valve opens a secondary fuel route around the metered valve to provide for a total responsive system.

The fourth embodiment of the invention (FIG. 7) features the two fuel metering valves **10*a* and 10*b* arrangement of the second embodiment (FIG. 4) with the metering of valve 10*a* responsive to a higher or reduced vacuum in the manifold by mechanical instead of electrical means. A reduction of the vacuum in the intake manifold operates transducer 26 to position stem 34 to the right in FIG. 7, causing pivotal L-bracket 36 to move clockwise retracting rod 19 and valve stem 16*a* from fuel passageway 14*a* and causes increased fuel to enter passageway 14*a*. An increase in vacuum in the manifold causes pivotal L-bracket 36 to move counterclockwise resulting in the insertion of rod 19*a* and valve stem 16*a* in fuel passageway 14*a*** and reduction in the fuel supply.

The various embodiments of the present invention illustrate a continuous and instantaneous method of monitoring the temperature of the exhaust gas and vacuum of the manifold. The thermistor's quality of decreasing resistance in proportion to the increase in temperature of the exhaust gas allows the thermistor to vary its resistance and to regulate the current which increases and decreases due to the temperature. The changes in the current act on the windings of an electric linear drive motor and position a connecting rod and stem within a metered valve to adjust the fuel supply in response to the demands of the engine as indicated by the exhaust gas. Parallel to sampling the exhaust gas, a transducer which is linked to the manifold vacuum responds by moving a connecting stem across a resistor so as to increase current in a second circuit as the vacuum diminishes and decreases current as the vacuum increases. The current of the second circuit acts on an alternate winding of the electrical linear drive motor to influence the rod and stem in the metered valve and the fuel supply in a like manner. Alternate embodiments feature twin fuel metered valves, one regulated by an electrical linear drive motor in the exhaust gas and the other by a motor in the manifold vacuum system, an embodiment having an unobstructed valve associated with an exhaust gas regulated valve and an embodiment having the metered valve in the manifold vacuum system regulated by mechanical linkage.

In addition it should be noted that amplifiers in the exhaust gas and vacuum systems are not restricted to the embodiment presented.

I claim:

1. In a carburetor, a device for the porportional mixing of fuel and air for induction into an internal combustion engine, comprising:

means for defining a fuel chamber;

a fuel mixing conduit having an air inlet at one end, a fuel/air outlet at the opposite end and a venturi throat between said inlet and said outlet;

a fuel metering valve operatively arranged to discharge fuel into said throat;

an orifice operatively connected between said fuel chamber and said valve to supply fuel to said valve;

a rod and stem adjustable positioned at said orifice to control the flow of fuel therethrough;

means responsive to the engine manifold vacuum to adjust said rod and stem in a direction to increase the flow of fuel to said valve when the engine vacuum diminishes and in the opposite direction to decrease the flow of fuel to said valve when the engine vacuum increases;

means responsive to the engine exhaust temperature to adjust said rod and stem in a direction to increase the flow of fuel to said valve when the engine exhaust temperature increases and in the opposite direction to decrease the flow of fuel to said valve when the engine exhaust temperature decreases, whereby the richness of the fuel/air mixture is controlled jointly by the engine vacuum and the engine exhaust temperature;

the improvement wherein:

said temperature responsive means comprises an electric linear drive motor means for driving said valve member to control the flow of fuel at said fuel metering valve;

thermistor means electrically responsive to the engine exhaust temperature to provide a variable resistance; and circuit means including amplifier means coupling said thermistor means to said electric linear drive motor means for supplying an electric current to said electric linear drive motor means which varies in proportion to the resistance of said thermistor means to provide said bi-directional movement of said fuel metering valve.

2. In a carburetor as recited in claim 1, wherein:

said vacuum responsive means comprises said electric linear drive motor means for driving said fuel metering valve to control the flow of fuel at said orifice;

transducer means electro-mechanically responsive to the engine vacuum through an extended arm acting upon a resistor means to provide a variable resistance; and circuit means including amplifier means coupling said transducer means to said electric linear drive motor means for supplying an electric current to said electric linear drive motor means which varies in proportion to the resistance of said transducer means to provide bidirectional movement of said valve means.

3. In a carburetor as recited in claim 2, wherein:

said fuel metering valve comprises a first metering valve and a second metering valve;

said orifice comprises a first orifice and a second orifice;

said rod and stem comprises a first rod and stem and a second rod and stem;

means responsive to the engine manifold vacuum to adjust said first rod and stem to meter said first metering valve;

means responsive to the engine exhaust temperature to adjust said second rod and stem to meter said second metering valve;

said temperature responsive means comprises an electric linear drive motor means for driving said second metering valve;

circuit means coupling said thermistor means to said electric linear drive motor means to provide said bi-directional movement to said metering valve;

said vacuum responsive means comprises a first linear reciprocating electric motor means for driving said first metering valve; and circuit means coupling said transducer means to said first linear reciprocal electric motor to provide said bi-directional movement to said first metering valve.

4. In a carburetor as recited in claim 3, wherein:

said fuel metering valve comprises a first metering valve and an unobstructed valve having a common emission.

5. In a thermal and vacuum tracking carburetor jet as recited in claim 1, wherein:

said fuel metering valve comprises a first metering valve and a second metering valve;

said orifice comprises a first orifice and a second orifice;

means responsive to the engine manifold vacuum pressure to adjust said first rod and stem to meter said first metering valve;

means responsive to the engine exhaust temperature to adjust said second rod and stem to meter said second metering valve;

said temperature responsive means comprises an electric linear drive motor means for driving said second metering valve;

circuit means coupling said thermistor to said electric linear drive motor means to provide said bi-directional movement to said second metering valve;

vacuum responsive means comprising a pivotally mounted L-bracket for driving said first fuel metering valve;

transducer means mechanically responsive to the engine vacuum through an extended arm acting upon said pivotally mounted L-bracket coupling said transducer means to said first rod and stem to provide bi-directional movement of said valve means.

* * * * *